US005757271A

United States Patent [19]

Andrews

[11] Patent Number: 5,757,271

[45] Date of Patent: May 26, 1998

[54] PORTABLE COMPUTER AND METHOD OF PROVIDING SECURITY FOR AN ELECTRONIC DEVICE

[75] Inventor: Greg P. Andrews, Rochester, Minn.

[73] Assignee: International Business Machines Corporation, Armonk, N.Y.

[21] Appl. No.: 747,312

[22] Filed: Nov. 12, 1996

[51] Int. Cl.[6] ..... G08B 13/14

[52] U.S. Cl. ..... 340/568; 340/571; 340/572; 340/539; 340/686; 340/689

[58] Field of Search ..... 340/568, 571, 340/572, 539, 686, 689

[56] References Cited

U.S. PATENT DOCUMENTS

| | | | |
|---|---|---|---|
| 3,988,724 | 10/1976 | Anderson | 340/539 |
| 4,337,462 | 6/1982 | Lemelson | 340/572 |
| 4,686,514 | 8/1987 | Liptak et al. | 340/571 |
| 4,908,608 | 3/1990 | Reinke et al. | 340/571 |
| 4,985,695 | 1/1991 | Wilkinson et al. | 340/571 |
| 4,999,621 | 3/1991 | Loeb | 340/825.34 |
| 5,142,269 | 8/1992 | Mueller | 340/568 |
| 5,317,304 | 5/1994 | Choi | 340/571 |
| 5,345,221 | 9/1994 | Pons et al. | 340/571 |
| 5,406,261 | 4/1995 | Glenn | 340/571 |
| 5,493,878 | 2/1996 | Murray, Jr. et al. | 70/58 |
| 5,578,991 | 11/1996 | Scholder | 340/571 |

*Primary Examiner*—Jeffery Hofsass
*Assistant Examiner*—Benjamin C. Lee
*Attorney, Agent, or Firm*—Andrew J. Dillon

[57] ABSTRACT

A portable computer and method of providing security for an electronic device are described. According to the method of the present invention, a security device disposed within a first electronic device is armed. The security device, which has at least a first mode of operation, detects whether or not a second electronic device is within a selected proximity of the first electronic device. In response to a detection that the second electronic device is not within the selected proximity of the first electronic device, a signal is generated indicating that a security violation has occurred. In one embodiment, wireless signals having an effective range equal to the selected proximity are transmitted from the second electronic device to the first electronic device. The security device determines that the first electronic device is not within the selected proximity of the second electronic device in response to a failure to receive the wireless signals.

20 Claims, 4 Drawing Sheets

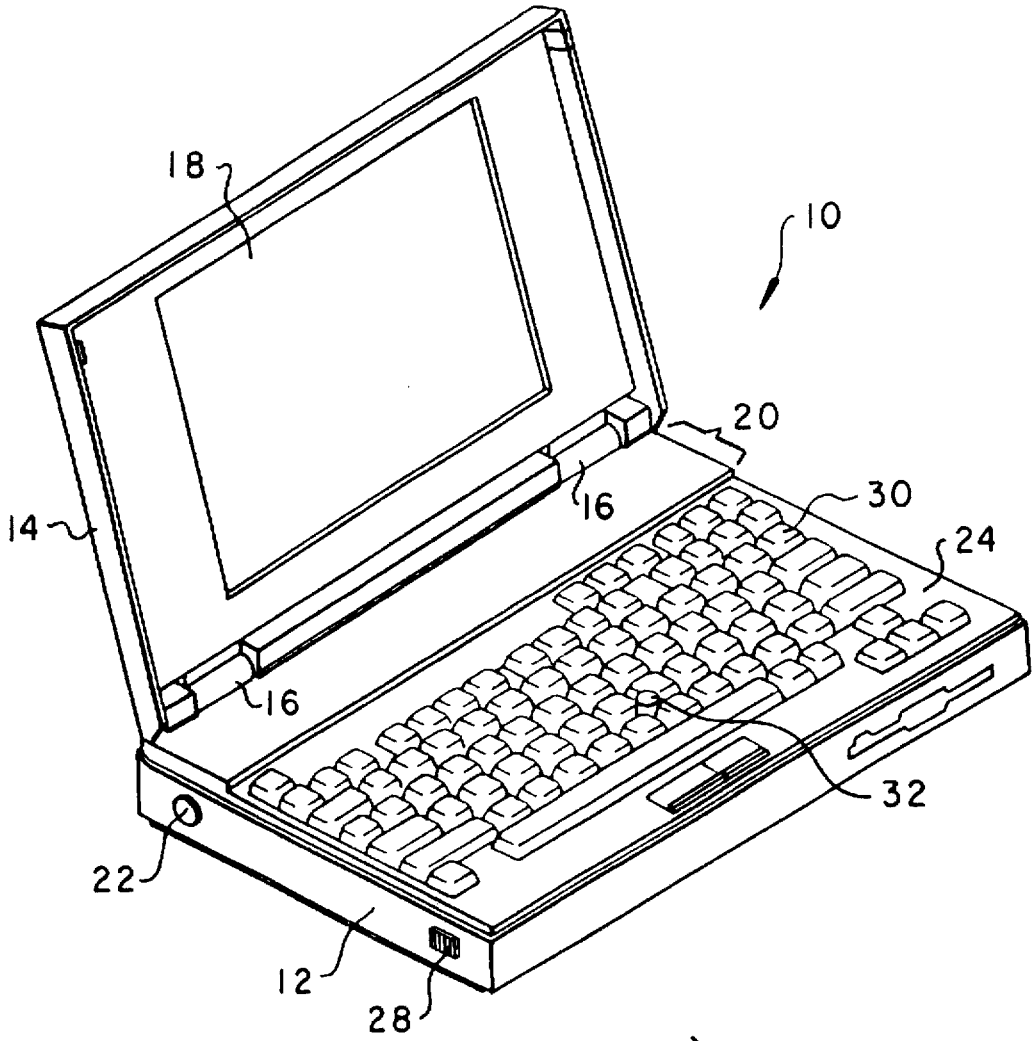
Fig. 1
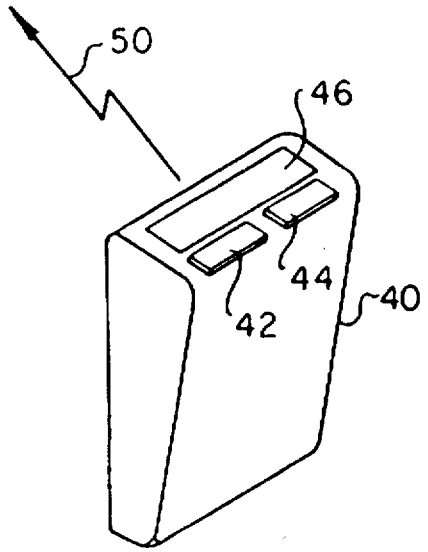

BEGIN
150
INPUT RECEIVED ?
152
YES
NO
ARMED IN FIRST MODE ?
154
NO
YES
MOTION ?
158
YES
NO
TIME = ZERO ?
156
NO
YES
ARMED IN SECOND MODE ?
160
NO
YES
USER INPUT ?
162
YES
NO
ARMED IN THIRD MODE ?
164
NO
YES
DISARM SIGNAL ?
170
YES
NO
DISARM SECURITY DEVICE IF ARMED
172
ARM SIGNAL ?
174
YES
NO
ARM SECURITY DEVICE IF DISARMED
176
FIRST MODE ?
177
NO
YES
MODE SIGNAL ?
178
NO
YES
RESET AND ENABLE TIMER
182
SET MODE AS INDICATED
180
ALARM
190

PORTABLE COMPUTER AND METHOD OF PROVIDING SECURITY FOR AN ELECTRONIC DEVICE

BACKGROUND OF THE INVENTION

1. Technical Field

The present invention relates in general to electronic devices and in particular to a method and system for providing security for an electronic device. Still more particularly, the present invention relates to a method and system for providing security for an electronic device which signal that a security violation has occurred when a remote unit is not within a selected proximity of the electronic device.

2. Description of the Related Art

The recent proliferation of portable computers has been accompanied by an increase in the theft of portable computers. The increase in portable computer theft has led to the development of security devices constructed to prevent the theft of a portable computer and the data stored therein.

Presently available portable computer security devices typically rely on a physical restraint, such as a cable or locking case, to prevent removal of a portable computer from a surface to which the portable computer is attached. More sophisticated portable computer security devices incorporate motion detectors (similar to those found in automobile alarm systems), which sound an audible alarm when the portable computer is moved. Although these prior art portable computer security devices provide an additional measure of security when a portable computer is stationary, the use of such prior art portable computer security devices is impractical while a portable computer is being transported.

As should thus be apparent, it would be desirable to provide an improved method and system for providing security for a portable computer which can be employed while a portable computer is being transported.

SUMMARY OF THE INVENTION

It is therefore one object of the present invention to provide an improved method and system for providing security for an electronic device.

It is another object of the present invention to provide an improved method and system for providing security for an electronic device which signal that a security violation has occurred when a remote unit is not within a selected proximity of the electronic device.

The foregoing objects are achieved as is now described. A portable computer and method of providing security for an electronic device are provided. According to the method of the present invention, a security device disposed within a first electronic device is armed. The security device, which has at least a first mode of operation, detects whether or not a second electronic device is within a selected proximity of the first electronic device. In response to a detection that the second electronic device is not within the selected proximity of the first electronic device, a signal is generated indicating that a security violation has occurred. In one embodiment, wireless signals having an effective range equal to the selected proximity are transmitted from the second electronic device to the first electronic device. The security device determines that the first electronic device is not within the selected proximity of the second electronic device in response to a failure to receive the wireless signals.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 depicts an illustrative embodiment of a portable computer having a security device in accordance with the present invention;

DETAILED DESCRIPTION OF PREFERRED EMBODIMENT

Figure 2:
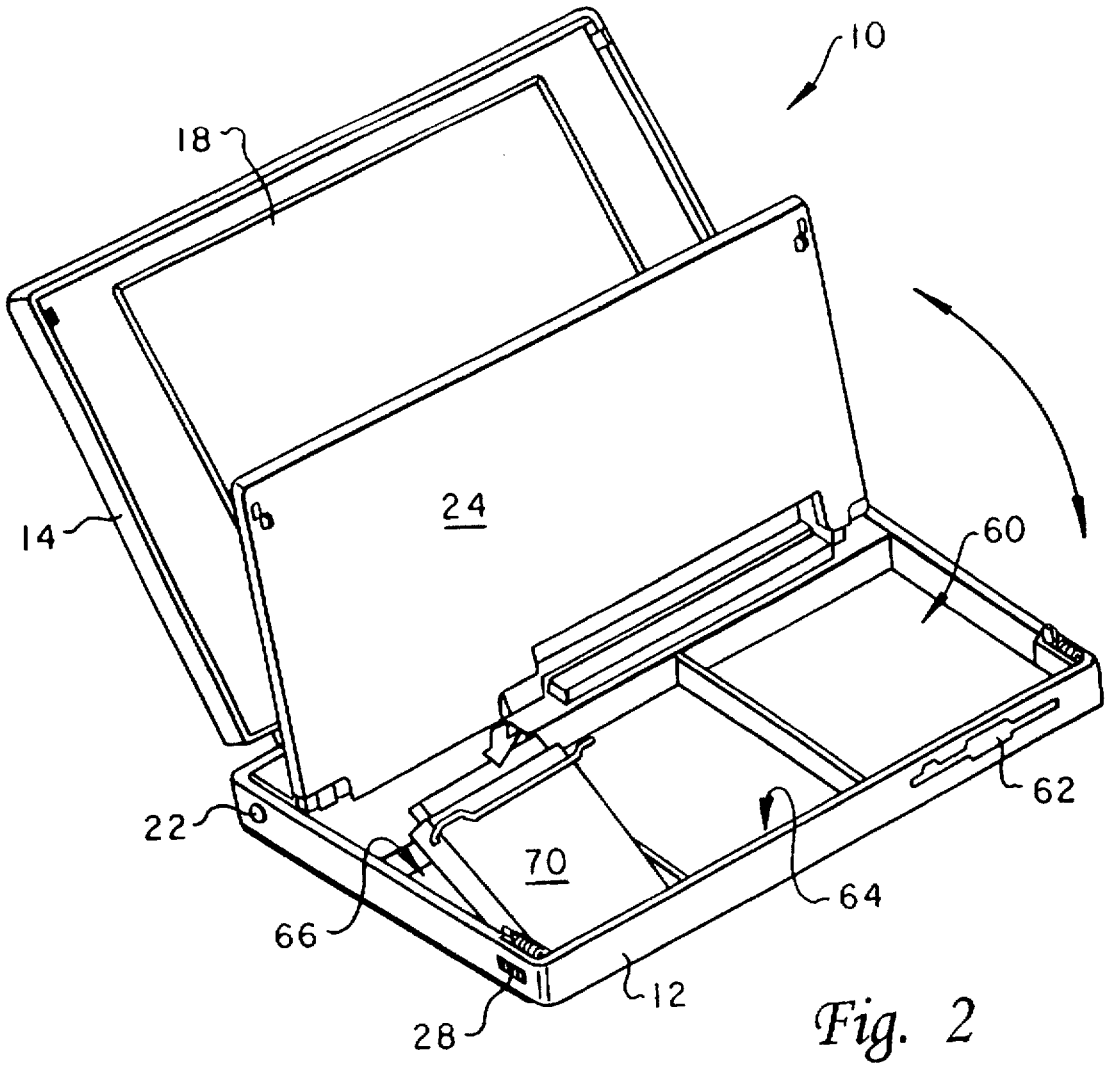
FIG. 2 is a second pictorial representation of the portable computer depicted in FIG. 1, wherein the keyboard is shown in a raised position.

With reference now to the figures and in particular with reference to FIG. 1, there is depicted an illustrative embodiment of a portable computer and a remote unit in accordance with the present invention. As illustrated, portable computer 10 comprises a main body 12 and a cover 14. A pair of integral hinges 16 are formed at the rear edge of main body 12 and permit cover 14 to be openable and closeable with respect to main body 12. A display device 18 is disposed within the interior of cover 14 in order to permit information to be displayed to a user of portable computer 10.

Main body 12 includes a rear portion 20 that houses the principal electronic components of portable computer 10. Power is supplied to and removed from the components of portable computer 10 by depressing two-state power switch 22. Main body 12 further includes a keyboard 24, which during use of portable computer 10 is typically positioned as illustrated in FIG. 1. However, as depicted in FIG. 2, the rear edge of keyboard 24 is rotatably mounted to the leading edge of rear portion 20 so as to be openable and closeable with respect to the remainder of main body 12 in response to manipulation of a sliding switch 28 located on each side of main body 12. In addition to keys 30, keyboard 24 is provided with a graphical pointing device 32, which may be utilized to control the position of a graphical pointer displayed within display device 18.

Also illustrated in FIG. 1 is a remote unit 40, which is preferably worn or carried by the owner of portable computer 10. As described below, remote unit 40 can be utilized by the owner of portable computer 10 to remotely control and monitor the operation of a security device disposed within main body 12. Remote unit 40 has an arm button 42, which is depressed to arm and disarm the security device, and a mode button 44, which can be utilized to select the mode of operation of the security device. In addition, remote unit 40 has a LCD display 46 that displays messages to the owner confirming selections made with arm button 42 and mode button 44. As indicated by arrow 50, remote unit 40 further includes a transmitter for transmitting short range (e.g., 5 meters) wireless signals to the security device disposed within main body 12 of portable computer 10. The wireless signals represented by arrow 50 can include RF (radio frequency), infrared, ultrasonic, or other wireless communication signals. In addition to control signals relaying control information input by the owner of portable computer 10 utilizing buttons 42 and 44, the wireless signals transmitted by remote unit 40 include a periodic proximity signal that, if detected by the security device within portable computer 10, indicates that remote unit 40 is within a selected proximity of portable computer 10.

Referring now to FIG. 2, there is illustrated a second pictorial representation of the portable computer depicted in FIG. 1. As noted above, in FIG. 2 keyboard 24, which is pivotable with respect to main body 12, is depicted in a raised position. Beneath keyboard 24, three bays for housing removable peripheral components are provided. Bay 60 is sized to accommodate a diskette drive into which a 3.5" disk may be inserted via slot 62. Similarly, an optical disk drive may optionally be installed within bay 64. As depicted, a security device 70 in accordance with the present invention is installable within bay 66. Security device 70 is preferably constructed such that power is automatically supplied to security device 70 upon installation within bay 66.

Figure 3:
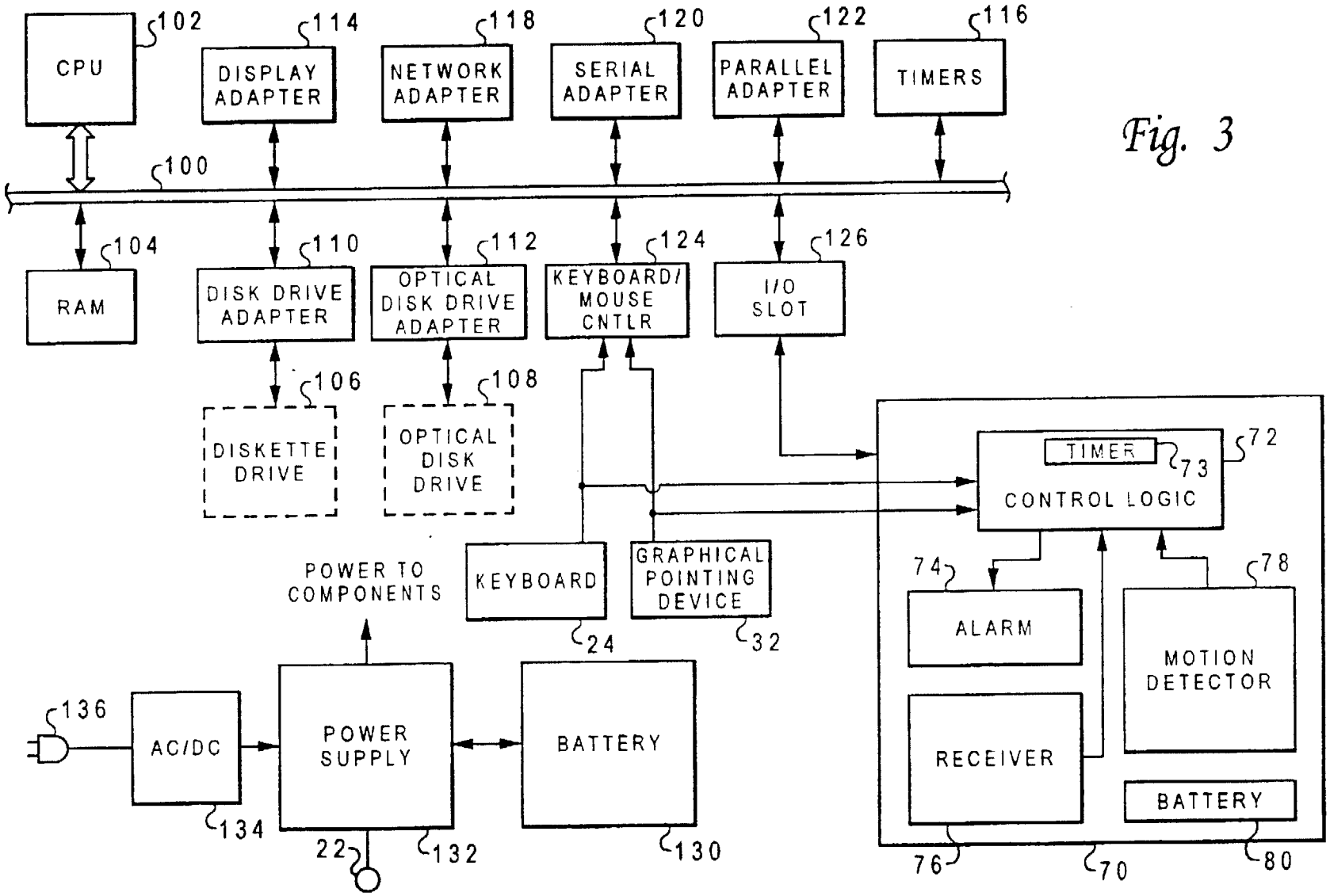
FIG. 3 depicts a block diagram of the principal components of the portable computer depicted FIG. 1.

With reference now to FIG. 3, there is depicted a block diagram representation of the principal components of portable computer 10 that are disposed within rear portion 20. As illustrated, portable computer 10 includes a system bus 100 to which numerous components are coupled for communication. The components include a central processing unit (CPU) 102, which executes software instructions stored either internally within an on-board cache or in RAM (random access memory) 104. While any appropriate processor can be utilized, CPU 102 is preferably one of the PowerPC™ line of microprocessors available from IBM Microelectronics. As described above with respect to FIG. 2, the storage provided by RAM 104 can optionally be augmented with nonvolatile storage such as diskette drive 106 and optical disk drive 108, which can be installed in bays 60 and 64, respectively. Diskette drive 106 and optical disk drive 108 communicate with CPU 102 via disk drive adapter 110 and optical disk drive adapter 112, respectively.

The components coupled to system bus 100 further include display adapter 114, which translates graphics data received from CPU 102 into video signals utilized to drive display device 18. Depending upon the operating system and application software running, the visual output of display device 18 may include text, graphics, animation, and multimedia video. The application and operating system software executed by CPU 102 can utilize multiple interval timers 80 to time one or more selected events within portable computer 10, for example, the interval between instances of a selected input.

Further coupled to system bus 100 are network adapter 118, serial adapter 120, and parallel adapter 122, which each can be utilized to communicate data between portable computer 10 and another data processing system or peripheral device utilizing a particular communication protocol. For example, serial adapter 120 provides a synchronous or asynchronous serial interface governed by a serial communication protocol such as RS—232, RS—422, or the like. Parallel adapter 122 facilitates the transmission and reception of data in a parallel format through an unillustrated parallel port. Network adapter 118 is utilized to connect portable computer 10 to an unillustrated network employing, for example, the TCP/IP communication protocol.

The illustrated components coupled to system bus 100 finally include keyboard/mouse controller 124 and I/O slot 126. Keyboard/mouse controller 124 receives signals generated by pressing (and releasing) keys 30 and manipulating graphical pointing device 32. Keyboard/mouse controller 124 translates the signals into a format understood by the operating system of portable computer 10 and then issues an interrupt to CPU 102 to indicate that a user input has been received. As illustrated, the signals generated by keyboard 24 and graphical pointing device 32 are also transmitted to security device 70, which is coupled to system bus 100 via the connection provided by I/O slot 126.

Still referring to FIG. 3, security device 70 comprises alarm 74, receiver 76, and motion detector 78, which are each electrically coupled to control logic 72 and battery 80. Receiver 76 detects the short range wireless signals transmitted by remote unit 40 and conveys any detected wireless signals to control logic 72. Thus, receiver 76 functions as a proximity detector that indicates whether or not remote unit 40 is within a selected proximity (i.e., the range of the transmitter within remote unit 40) of portable computer 10. Motion detector 78, which can comprise one or more mercury switches, strain gauges, or other means for detecting movement of portable computer 10, similarly signals control logic 72 in response to detecting movement of portable computer 10. As noted above, user inputs detected by keyboard 24 and graphical pointing device 32 are also transmitted to control logic 72.

As depicted, control logic 72, which controls the operation of security device 70, includes a countdown timer 73 for timing the interval between selected inputs. In a preferred embodiment of the present invention, control logic 72 can be described as being in one of two states (armed or disarmed) and in one of three modes of operation: proximity detection, motion detection, or user input detection. In the disarmed state, control logic 72 responds to control inputs relayed by receiver 76 in order to permit the owner of portable computer 10 to arm control logic 72 and select a mode of operation. Inputs generated by keyboard 24, graphical pointing device 32, and motion detector 78 are ignored. However, when control logic 72 is in the armed state, control logic 72 actuates alarm 74 in response to receipt of an input corresponding to the current mode of operation of control logic 72. In a preferred embodiment of the present invention, alarm 74 comprises a high decibel siren. Alarm 74 can additionally include a long range wireless transmitter that transmits wireless signals to remote unit 40 in order to alert the owner of portable computer 10 that a security violation has occurred.

As illustrated, portable computer 10 further includes power supply 132, which is coupled to both portable computer battery 130 and AC to DC transformer 134. AC to DC transformer 134 is connectable to an AC power source by plug 136. As is typical of portable computers, when AC to DC transformer 134 is supplying power to power supply 132, power supply 132 charges portable computer battery 130 if power switch 22 is in an OFF position and supplies power to the components of portable computer 10 if power switch 22 is in an ON position. Alternatively, if power switch 22 is in the ON position and power supply 132 is not receiving power from AC to DC transformer 134, power supply 132 supplies power to the components of portable computer 10 from portable computer battery 130. The operating system of portable computer 10 preferably supports a suspend or sleep state in which power supply 132 provides power only to selected components of portable computer 10 in order to lengthen the operating life of portable computer battery 130.

Figure 4:
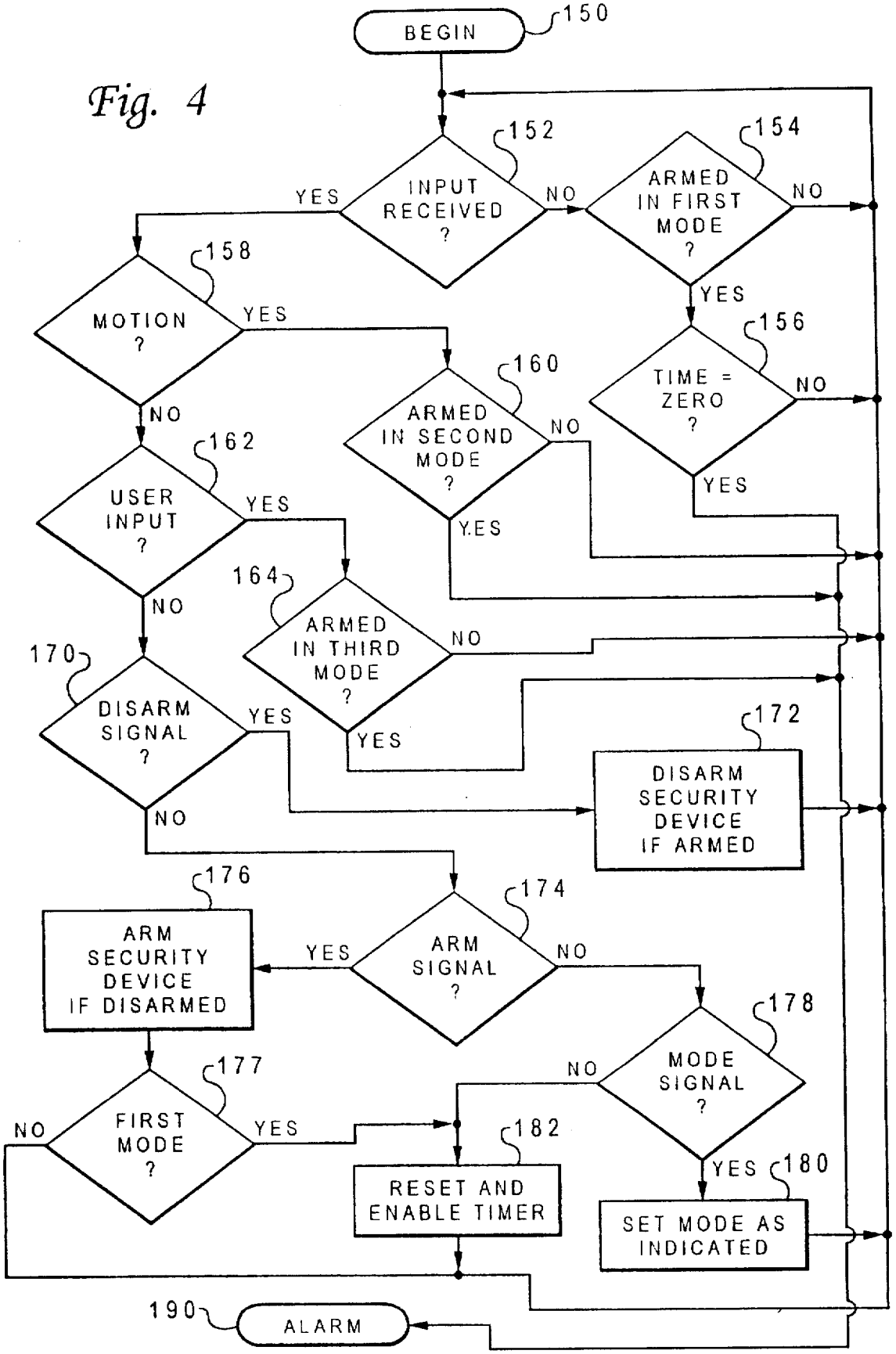
FIG. 4 is a high level logical flowchart of a preferred embodiment of a method for providing security for a portable computer in accordance with the present invention.

Referring now to FIG. 4, there is illustrated a high level logical flowchart of the operation of control logic 72. As depicted, the process begins at block 150 and thereafter proceeds to block 152, which illustrates a determination of whether or not an input has been received by control logic 72. If not, the process proceeds to block 154, which depicts a determination of whether or not control logic 72 is in an armed state and in the first mode of operation in which control logic 72 functions as a proximity detector. In response to a determination at block 154 that control logic 72 is not armed and in the first mode of operation, the process returns to block 152. However, in response to a determination at block 154 that control logic 72 is armed and in the first mode of operation, the process proceeds to block 156, which illustrates a determination of whether or not the value of countdown timer 73 is equal to zero, indicating that an input has not been received from remote unit 40 within a predetermined time period, for example, 5 seconds. In response to a determination at block 156 that the timer has not elapsed, the process returns to block 152 in the manner which has been described. Referring again to block 156, in response to a determination that the timer has elapsed and that remote unit 40 is therefore not within a selected proximity of portable computer 10, the process passes from block 156 to block 190, which depicts control logic 72 actuating alarm 74.

Returning to block 152, in response to a determination that an input has been received by control logic 72, the process proceeds to block 158. Block 158 depicts a determination of whether or not control logic 72 received the input from motion detector 78. If so, the process proceeds from block 158 to block 160, which illustrates a determination of whether or not control logic 72 is armed in a second mode of operation in which security device 70 functions as a motion detector. In response to a determination at block 160 that control logic 72 is not armed and in the second mode of operation, the process returns to block 152. However, in response to a determination that control logic 72 is armed and in the second mode of operation, the process proceeds from block 160 to block 190, which depicts control logic 72 actuating alarm 74.

Returning to block 158, in response to a determination that the input was not received from motion detector 78, the process proceeds to block 162, which illustrates a determination of whether or not the input was received from either keyboard 24 or graphical pointing device 32. If so, the process passes to block 164, which depicts a determination of whether or not control logic 72 is armed and in a second mode of operation in which security device 70 functions as an user input detector. In response to a determination at block 164 that control logic 72 is not armed and in the third mode of operation, the process returns to block 152 in the manner that has been described. However, in response to a determination at block 164 that control logic 72 is armed and in the third mode operation, the process proceeds to block 190, which depicts control logic 72 to actuating alarm 74.

Referring again to block 162, in response to a determination that the input was not received from keyboard 24 or graphical pointing device 32, the process passes to block 170, which depicts a determination of whether or not the received input is a disarm signal transmitted by remote unit 40. If so, the process proceeds from block 170 to block 172, which illustrates control logic 72 switching into the disarmed state. The process returns from block 172 to block 152 in the manner which has been described. However, in response to a determination at block 170 that the received input is not a disarm signal, the process passes to block 174. Block 174 illustrates a determination of whether or not the received input is an arm signal transmitted by remote unit 40. If so, the process passes to block 176, which depicts control logic 72 switching from a disarmed state to an armed state. Next, the process proceeds to block 177, which illustrates a determination of whether or not control logic is in the first mode of operation. If not, the process simply returns to block 152 to await the next input. However, in response to a determination at block 177 that control logic 72 is in the first mode of operation, the process proceeds to block 182, which illustrates control logic 72 resetting countdown timer 73 to a selected value and enabling countdown timer 73 to begin decrementing. The process then returns to block 152 in the manner that has been described.

Returning to block 174, in response to a determination that the received input is not an arm signal, the process passes to block 178, which illustrates a determination of whether or not the received input is a mode signal transmitted by remote unit 40. If so, the process passes to block 180, which depicts control logic 72 switching to the indicated mode of operation. The process then returns to block 152 in the manner which has been described. However, in response to a determination at block 178 that the received input is not a mode signal, thereby indicating that the received signal is a periodic proximity signal transmitted by remote unit 40, the process passes to block 182, which has been described. Thereafter, the process then returns to block 152.

As has been described, the present invention provides an improved method and system for providing security for a portable computer. In accordance with a preferred embodiment of the present invention, the security device supports multiple modes of operation, including a first mode in which the security device functions as a proximity detector. Although the present invention has been described with reference to a preferred embodiment that implements the security device of the present invention in hardware, those skilled in the art will appreciate that the control functions provided by control logic 72 may in an alternative embodiment be implemented by software running on CPU 102.

In this alternative embodiment, CPU 102 preferably executes a security program that implements the process depicted in FIG. 4 in response to the owner placing portable computer 10 in a low-power suspend state. Replacing control logic 72, the security program receives inputs from receiver 76 and motion detector 78 and transmit outputs to alarm 74 via I/O slot 126 and system bus 100. In addition, the security program utilizes software-accessible timers 116 to implement the timing function performed by timer 73. An advantage of this software-based alternative embodiment is that additional functionality can easily be implemented without the expense of additional hardware. For example, the security features hereinbefore described can be extended by causing additional software routines to be executed in response to the detection of a security violation, as illustrated at block 190 of FIG. 4. The additional software routines may perform security function such as deleting sensitive files from a hard disk drive coupled to disk drive adapter 110.

Moreover, although aspects of the present invention have been described with respect to specific "method steps" implementable within a computer system, those skilled in the art will appreciated from the foregoing description that in a second alternative embodiment the present invention may be implemented as a computer program product for use with a computer system. Those skilled in the art should readily appreciate that programs defining the functions of the present invention can be delivered to a computer via a variety of signal-bearing media, which include, but are not limited to: (a) information permanently stored on non-writable storage media (e.g., CD-ROM); (b) information alterably stored on writable storage media (floppy diskettes or hard disk drives); or (c) information conveyed to a computer through communication media, such as through a computer or telephone network. It should be understood, therefore, that such signal-bearing media, when carrying computer readable instructions that direct the method functions of the present invention, represent alternative embodiments of the present invention.

While the invention has been particularly shown and described with reference to a preferred embodiment, it will be understood by those skilled in the art that various changes in form and detail may be made therein without departing from the spirit and scope of the invention.

What is claimed is:

1. A method for providing security for data processing system including a memory and a processing unit, said method comprising:

arming a security device within a data processing system, said security device having at least a proximity detector and a signalling device;

detecting whether or not an electronic device is within a selected proximity of said data processing system utilizing said proximity detector of said security device; and in response to said detection while said security device is armed and operating in said first mode of operation, executing a program stored within said memory utilizing said processing unit, wherein execution of said program causes said signalling device to signal that a security violation has occurred.

2. The method of claim 1, wherein said step of signalling that a security violation has occurred comprises the step of sounding an audible alarm.

3. The method of claim 1, wherein said step of signalling that a security violation has occurred comprises the step of transmitting a wireless signal from said data processing system to said electronic device.

4. The method of claim 1, wherein said security device has a second mode of operation, said method further comprising:

detecting movement of said data processing system; and in response to said detection, signalling that a security violation has occurred if said security device is armed and operating in said second mode of operation.

5. The method of claim 1, wherein said data processing system includes a user input device and said security device has a second mode of operation, said further comprising the steps of:

detecting manipulation of said user input device; and in response to detection of manipulation of said user input device, signalling that a security violation has occurred if said security device is armed and operating in said second mode of operation.

6. The method of claim 1, wherein said step of detecting whether or not an electronic device is within a selected proximity comprises the steps of:

transmitting wireless signals from said electronic device; and detecting said wireless signals within said data processing system.

7. The method of claim 6, wherein said wireless signals have an effective range equal to said selected proximity.

8. A portable secured computer, comprising:

a body;

a processing unit within said body;

a memory coupled to said processing unit that stores a program executable by said processing unit;

a security device having at least a first mode of operation, said security device including:

a proximity detector that detects whether or not a remote unit is within a selected proximity of said portable computer, wherein said processing unit executes said program in response to a detection by said proximity detector that said remote unit is not within said selected proximity of said portable computer; and a signalling device that when said security device is in said first mode of operation signals that a security violation has occurred in response to execution of said program by said processing unit.

9. The portable computer of claim 8, wherein said signalling device comprises an audible alarm.

10. The portable computer of claim 8, wherein said signalling device comprises a transmitter that transmits a wireless signal to a remote electronic device.

11. The portable computer of claim 8, wherein said security device has a second mode of operation, said security device further comprising:

a motion detector, wherein in response to detection of motion by said motion detector while said security device is in said second mode, said processing unit executes said program to cause said signalling device to signal that a security violation has occurred.

12. The portable computer of claim 8, wherein:

said portable computer further comprises a user input device; and said security device has a second mode of operation and further comprises means for detecting manipulation of said user input device, wherein in response to detection of a user input while said security device is in said second mode, said processing unit executes said program to cause said signalling device to signal that a security violation has occurred.

13. The portable computer of claim 8, wherein said security device is removably insertable into said body of said portable computer.

14. The portable computer of claim 8, wherein said proximity detector comprises a receiver that receives wireless signals transmitted by said remote unit.

15. The portable computer of claim 14, wherein said proximity detector detects that said remote unit is outside said selected proximity in response to a failure to receive said wireless signals from said remote unit.

16. A program product usable with a data processing system being protected and having a proximity detector that detects whether or not a remote unit is within a selected proximity of said data processing system, said data processing system further including a signaling device for signaling that a security violation has occurred, said program product comprising:

a security program having at least a first mode and an armed state, wherein in response to receipt of an indication from said proximity detector that said remote unit is not within said selected proximity of said data processing system while said security program is in said first mode and said armed state, said security program actuates said signaling device; and a signal-bearing media bearing said security program.

17. The program product of claim 16, said data processing system further including a motion detector and said security program having a second mode, wherein said security program actuates said signalling device in response to detection of motion by said motion detector when said security program is in said armed state and in said second mode.

18. The program product of claim 16, said portable computer including a user input device and said security device having a second mode of operation, wherein said security program actuates said signalling device in response to detection of a user input while said security program is in said armed state and in said second mode.

19. The program product of claim 16, wherein said security program has a plurality of modes of operation and is capable of receiving a plurality of inputs that each correspond to a respective one of said plurality of modes of operation, and wherein said security program actuates said signalling device in response to receipt of an input corresponding to a particular mode among said plurality of modes while said security device is in both said particular mode and said armed state.

20. The program product of claim 16, and further comprising:

a second program stored within said memory, wherein said security program invokes execution of said second program within said data processing system in response to a detection by said proximity detector that said remote unit is not within said selected proximity of said data processing system.

* * * * *